United States Patent [19]

Kamman

[11] Patent Number: 4,697,845

[45] Date of Patent: Oct. 6, 1987

[54] LONG-RUNNING MOTOR-DRIVEN BABY SWING

[75] Inventor: Gordon W. Kamman, Elma, N.Y.

[73] Assignee: The Quaker Oats Company, Chicago, Ill.

[21] Appl. No.: 762,132

[22] Filed: Aug. 2, 1985

[51] Int. Cl.[4] ..... B60N 1/02; A47C 1/00

[52] U.S. Cl. ..... 297/118; 297/130; 297/281; 297/327; 297/377; 297/258; 272/86

[58] Field of Search ..... 272/86; 297/130, 131, 297/327, 365, 377, 281, 118

[56] References Cited

U.S. PATENT DOCUMENTS

| | | | |
|---|---|---|---|
| 3,361,405 | 1/1968 | Gottlieb | 272/86 X |
| 3,420,523 | 1/1969 | Foster | 272/86 |
| 4,150,820 | 4/1979 | Bochmann | 272/86 |
| 4,231,612 | 11/1980 | Meeker | 297/327 X |
| 4,240,625 | 12/1980 | Meeker | 272/86 |
| 4,324,432 | 4/1982 | Eldon et al. | 297/377 |
| 4,634,175 | 1/1987 | Wise | 297/377 |

*Primary Examiner*—Richard J. Johnson
*Attorney, Agent, or Firm*—Cumpston & Shaw

[57] ABSTRACT

A motor-driven baby swing is disclosed capable of swinging an improved baby chair for a prolonged period of time. The chair is usable in a swinging mode of operation, and also in a rigid mode of operation when detached from the swing. The chair is pivotally movable into a plurality of reclining positions in each mode of operation.

9 Claims, 7 Drawing Figures

LONG-RUNNING MOTOR-DRIVEN BABY SWING

BACKGROUND OF THE INVENTION

1. Field of the Invention

This invention relates generally to swings, and more specifically to an improved long-running motor-driven baby swing having improved adjustable chair means.

2. Description of the Prior Art

It is known in the prior art to provide a spring-driven baby swing comprising a weight which is adapted when lifed and released to supply power to a mechanism, which upon an initial manual swinging of the swing, imparts continuous swinging movement to the swing until the weight reaches the end of its travel.

SUMMARY OF THE INVENTION

In accordance with a preferred embodiment of the invention, an improved long-running motor-driven baby swing is disclosed having many advantageous features over known power-driven swings. The improved baby swing comprises a chair means coupled to a pivotally mounted support means. A negator spring drive motor means is intermittently drivingly coupled to the support means through a ratchet pawl means for imparting swinging movement to the chair means.

In another aspect of the invention, the chair means comprises a chair and a chair mount for supporting the chair for movement between a plurality of reclining positions.

In a more specific aspect of the invention, latch means are provided between the chair and the chair mount for selectively latching the chair in one of the pluarlity of reclining positions. The latch means comprises a pluarlity of arcuately arranged first gear teeth on the chair mount, and a reciprocally movable plunger having a lug defining a notch which is selectively engageable with one of the first gear teeth, a push button at one end extending through a first opening in the chair, and a spring on the plunger for biasing the notch into meshing engagement with one of the first gear teeth.

In a still more specific aspect of the invention, the latch means comprises a plurality of arcuately arranged second gear teeth angularly spaced from the first gear teeth, and limiting means for selectively limiting operation of the plunger to only one of the first and second gear teeth. The limiting means comprises first and second grooves in the chair mount in alignment with the first and second gear teeth respectively, the grooves having shoulders at each end thereof, and a pivotal stop member movable with the chair and interposed between the chair and chair mount. The stop member has an arcuate portion at one end having a lug biased by the plunge spring into a selected one of the grooves for slidable movement. The lug is engageable with the shoulders for positively limiting pivotal movement of the chair relative to the chair mount to the distance between the shoulders in either direction of rotation of the chair. The stop member further has a finger at its opposite end extending through a second opening in the chair. Manual pivotal movement of the finger against the bias of the plunger spring withdraws the lug from one of the first and second grooves clear of the shoulders. Accordingly, when the finger and push button are simultaneously depressed, the chair is free for movement on the chair mount to position the lug in the other of the first and second grooves, and the tooth in engagement with the other of the first and second gear teeth.

In a subcombination of the invention, a chair means is disclosed for supporting a baby in a plurality of reclining positions. The chair means comprises a chair having a fixed bearing member having a bearing surface. The chair is supported by a chair mount having a fixed projection having a sectorial peripheral surface complementary to the bearing surface and receiving it to allow limited rotational movement of the chair relative to the chair mount between a plurality of reclining positions. Latch means are provided between the chair and chair mount for selectively latching the chair in one of the plurality of reclining positions.

In another aspect of the chair means, the bearing member has an opening extending therethrough, and the latch means comprises a plurality of arcuately arranged gear teeth on the projection. The latch means further comprises a reciprocally movable plunger having a lug defining a notch engageable with one of the gear teeth. The plunger has a push button at one end extending through the bearing opening, and a spring thereon for biasing the lug into meshing engagement with the gear teeth. The opposite end of the plunger is bifurcated for receiving the projection therebetween, and the bifurcated ends are slotted for receiving spindles laterally extending from the projection. The plunger spring is interposed between the push button and the projection.

In a more specific aspect of the chair means, the chair mount has a pair of spaced rockers to form a rocking chair means, and ends of a U-shaped lever are pivotally mounted to one of the ends of the rockers. The lever is movable between a retracted position in which the chair means is free to rock, and an extended position in which the chair means is prevented from rocking.

A primary advantage of this invention is to provide an improved motor-driven baby swing capable of swinging a baby for an extended period of time, such as a half an hour, for example.

Another advantage of the invention is to provide a swing having a chair that is adjustable between a plurality of reclining positions when mounted on the swing, and also adjustable between a plurality of reclining positions when uncoupled from the swing and placed on a fixed support surface.

The invention and its advantages will become more apparent from the detailed description of the invention presented below.

BRIEF DESCRIPTION OF THE DRAWINGS

In the detailed description of the invention presented below, reference is made to the accompanying drawings, in which.

DETAILED DESCRIPTION OF THE INVENTION

Figure 1:
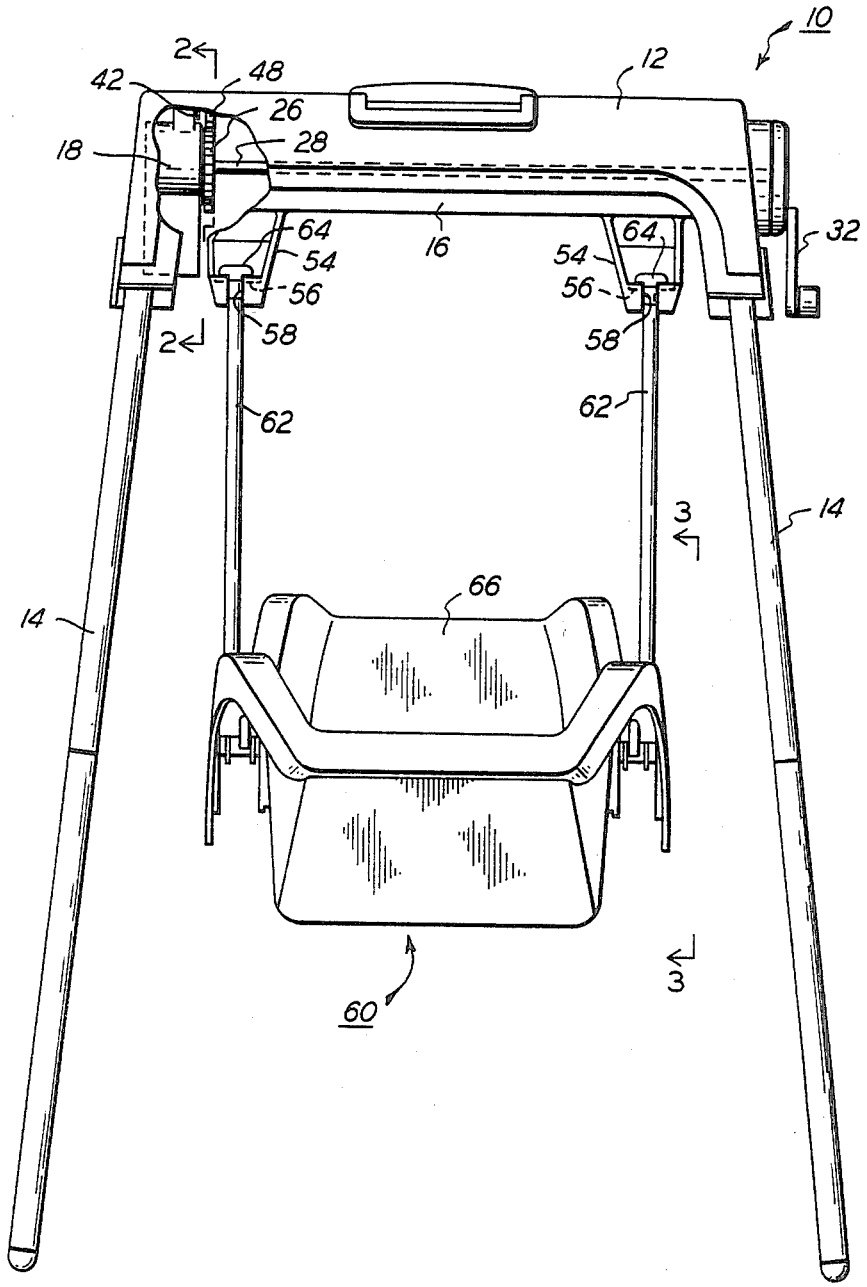
FIG. 1 is a front elevational view of a preferred embodiment of an improved motor-driven baby swing with a portion thereof broken away and sectional to illustrate the swing drive mechanism.
Figure 2:
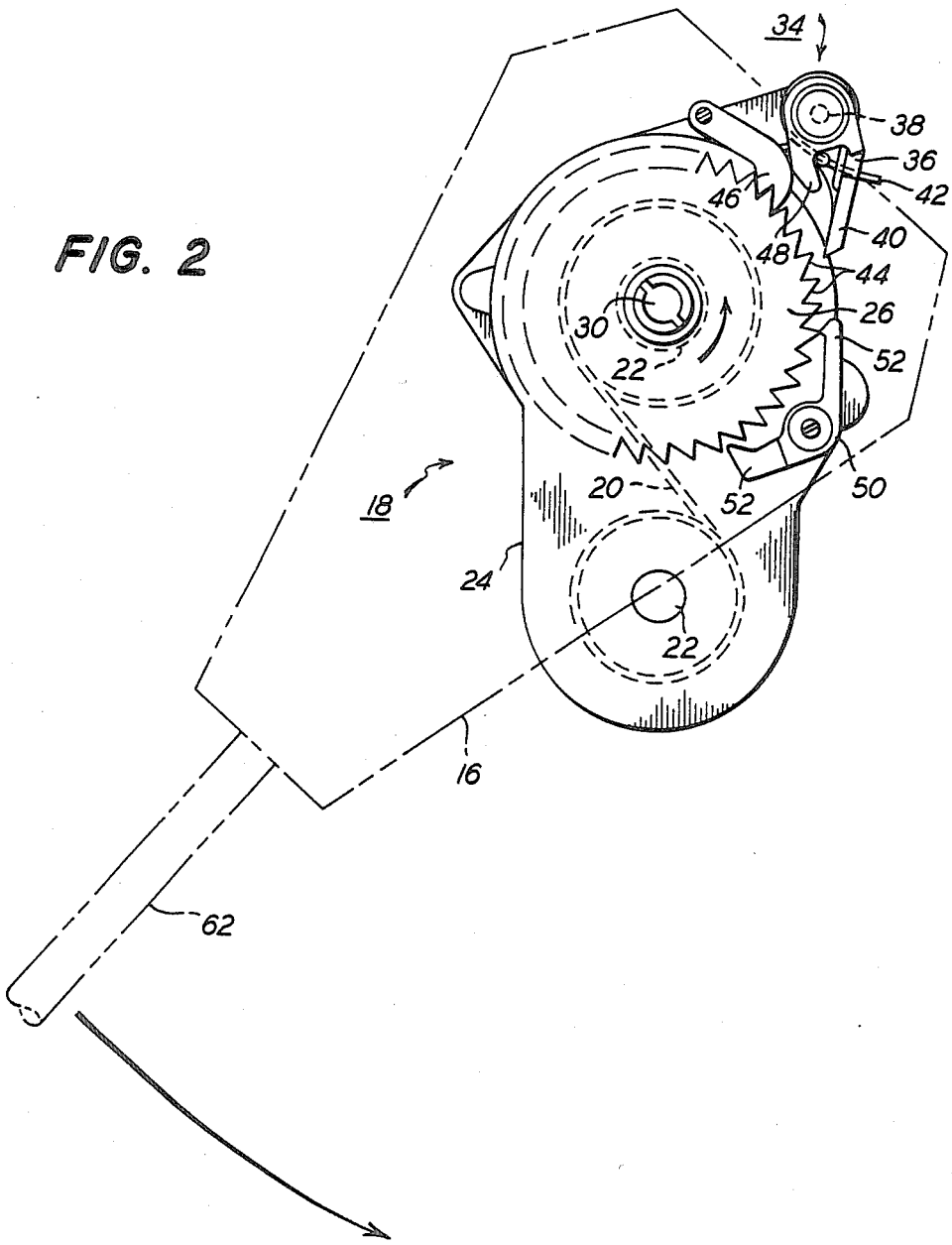
FIG. 2 is a section view of the drive mechanism taken substantially along line 2—2 of FIG. 1 and showing a part of the swing support means by broken lines.

Referring now to FIGS. 1 and 2 of the drawings, a preferred embodiment of an improved motor-driven long-running baby swing 10 is disclosed. The swing 10 comprises a transverse housing or frame member 12 supported by four inclined corner tubes 14 releasably secured at one of their ends to the housing. A transverse swing support frame 16 is pivotally mounted in a way to be explained hereinafter to housing 12 for swinging movement.

A drive means 18 as best seen in FIG. 2 is provided for imparting long-running pivotal movement to swing support frame 16. The drive means 18 comprises a conventional negator spring 20 secured to spindles 22 rotatably mounted in a rigidly mounted motor housing 24. Upper spindle 22 is drivingly secured to a toothed wheel 26, and spring 20 is tensioned by rotation of wheel 26 in a clockwise direction. This is achieved by a drive shaft 28 journaled for rotation in transverse housing 12, and having one end inserted in a central bore 30 in wheel 26 and drivingly coupled thereto by a pin and slot connection. A crank 32 is directly coupled to the other end of shaft 28 for clockwise rotation of the shaft and wheel 26 for winding spring 20 onto upper spindle 22. Spring 20 is held in its tensioned condition by a ratchet pawl means 34.

The ratchet pawl means 34 comprises a lever 36 pivotally mounted on a shaft 38 and having a finger 40 biased by a spring 42 into engagement with wheel teeth 44. The ratchet pawl means 34 allows rotation of wheel 26 in a spring winding or clockwise direction, but prevents rotation of wheel 26 in a spring-driven counterclockwise direction.

The means for supplying power intermittently from spring 20 to swing support frame 16 will now be described. The swing suport frame 16 is mounted for pivotal movement on drive shaft 28 by conventional bearing means, not shown. The support frame 16 has a notched drive pawl 46 rigidly secured thereto for pivotal movement. Rotation of support frame 16 in a clockwise direction to the broken line position shown in FIG. 2 causes drive pawl 46 to engage a guide pawl 48 and to be guided thereby into meshing engagement with a tooth 44 on wheel 26 and to impart slight movement thereto in a clockwise direction. The guide pawl 48 is pivotally mounted on shaft 38 and is spring biased away from lever 36 to provide some lost motion therebetween. Movement of wheel 26 in the clockwise direction causes finger 40 to ride on a tooth 44 which in combination with guide pawl 48 moves finger 40 outwardly clear of the teeth as seen in exaggerated form in FIG. 2. This releases spring 20 which drives wheel 26 a distance of one tooth in a counter-clockwise direction at which point the wheel is engaged by the spring biased finger 40 preventing any further wheel movement. The advance of wheel 26 a distance of one tooth in a counter-clockwise direction occurs in timed relation to the positions of swing support frame 16 and drive pawl 34 so that the spring power is applied thereto as support frame 16 reaches its uppermost point of travel. This intermittent application of power to swing support frame 16 occurs every time it reaches its uppermost point of travel in its clockwise direction.

The negator spring drive omtor 18 is further provided with a run-away pawl 50 to prevent the motor from running away in the event ratchet pawl 34 breaks. The run-away pawl 50 is freely pivotally mounted on housing 24 and has legs 52 engageable and disengageable with the points of the teeth 44 without positively engaging them. However, if finger 40 should break, for example, the rotation of wheel 26 in a counter-clockwise direction will pivot the pawl causing a leg 52 thereof to positively engage a tooth 44 and prevent the motor from running away.

When fully wound, negator spring 20 is capable of providing intermittent power to swing support frame 16 for about a half hour without rewinding. The swinging action is initiated by manually swinging swing support frame 16 causing drive pawl 46 to actuate ratchet pawl 34 which in turn intermittently causes spring motor 18 to impart power to support frame 16 for automatically continuing the swinging action.

The swing support frame 16 is further provided with a pair of spaced depending arms 54 (FIG. 1) having a flat recessed surface 56 and slot 58 extending therein for detachably supporting a swing in the form of a chair means 60. The chair means 60 comprises a U-shaped tubular frame in which legs 62 thereof have caps 64 secured thereto. The chair means 60 is lifted, the legs 62 of the frame are inserted into slots 58, and the chair means released whereby caps 64 nest in the recesses 56 for releasably holding the chair means to support frame 16 for swinging action.

Figure 3:
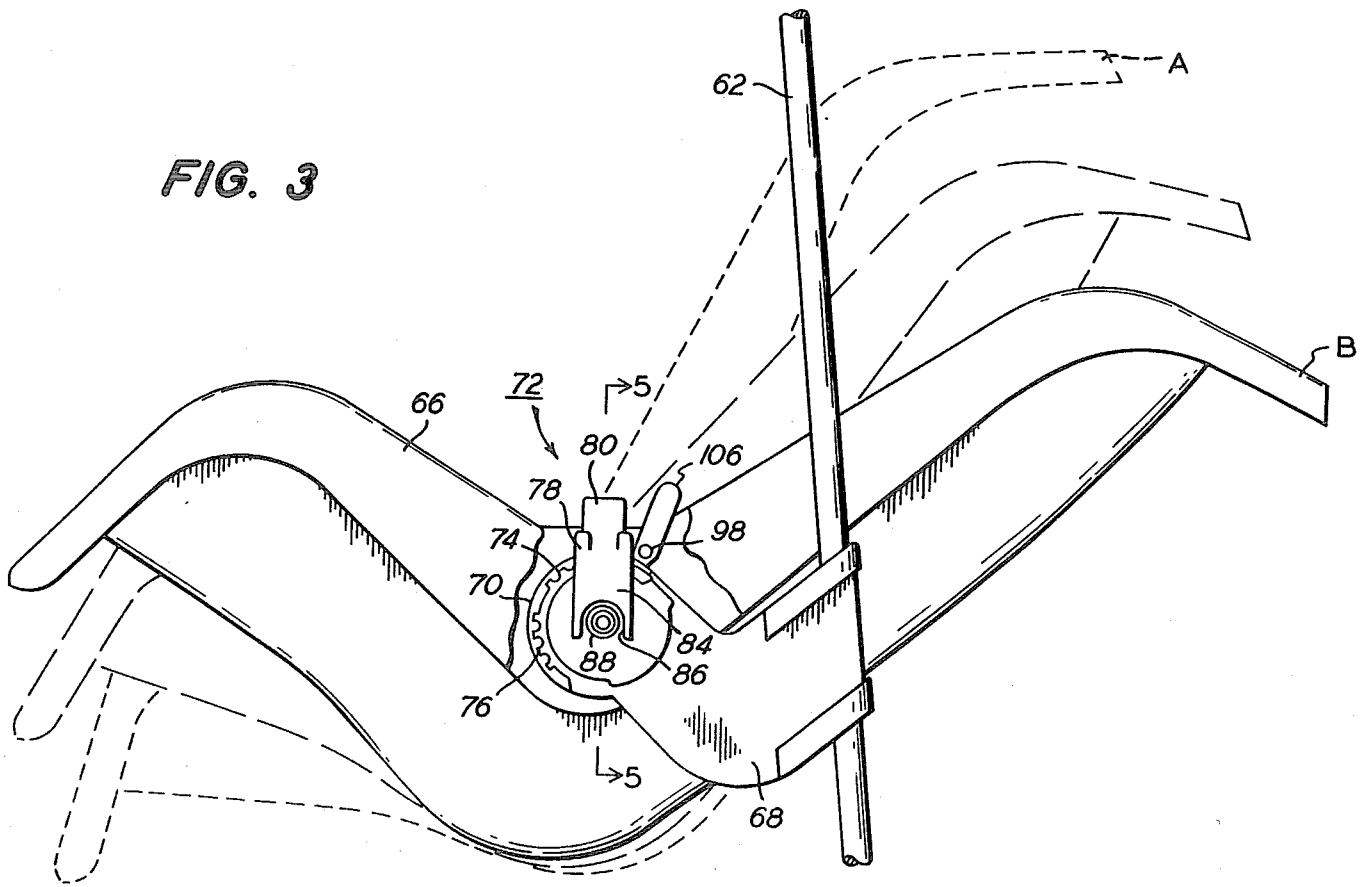
FIG. 3 is an enlarged side elevational view of the chair and chair mount of FIG. 1 looking at it from line 3—3 and showing by dotted lines two other reclining positions of the chair, and further showing by a broken away section, the mounting means between the chair and chair mount.
Figure 4:
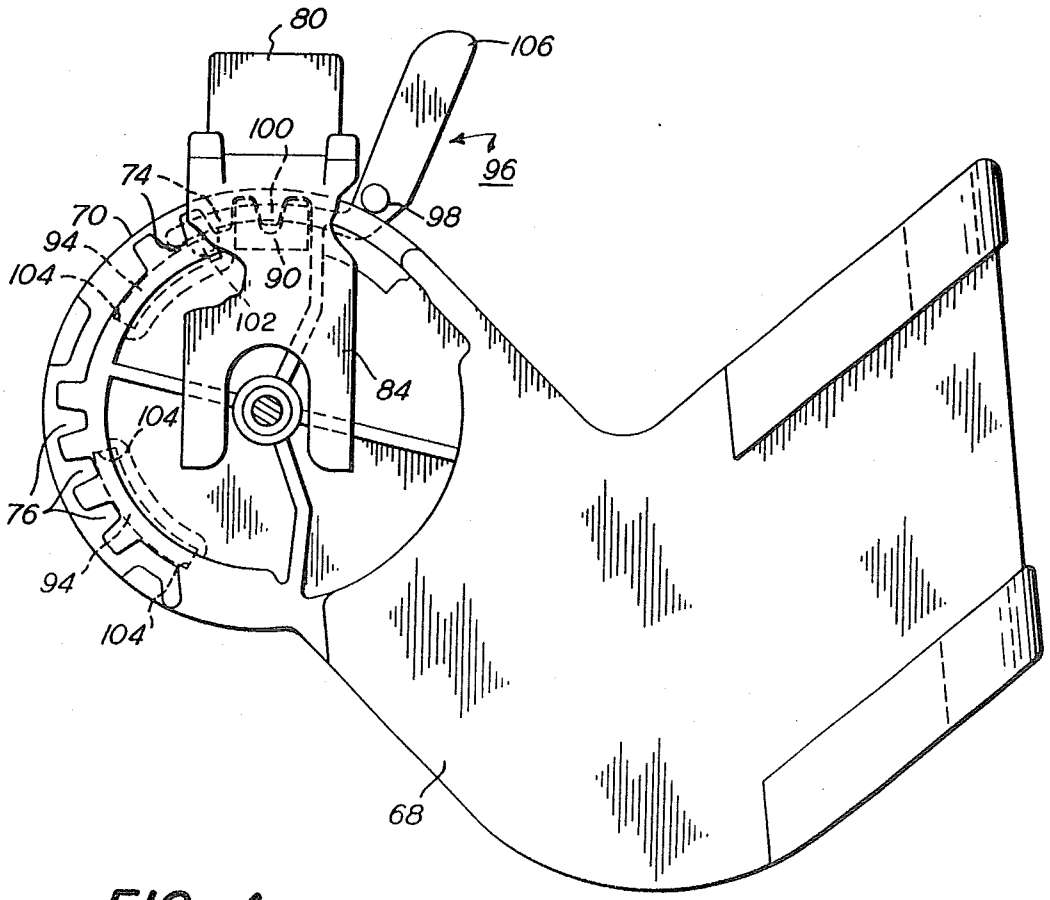
FIG. 4 is an enlarged side elevational view of one of the chair mounting means of FIG. 3.
Figure 5:
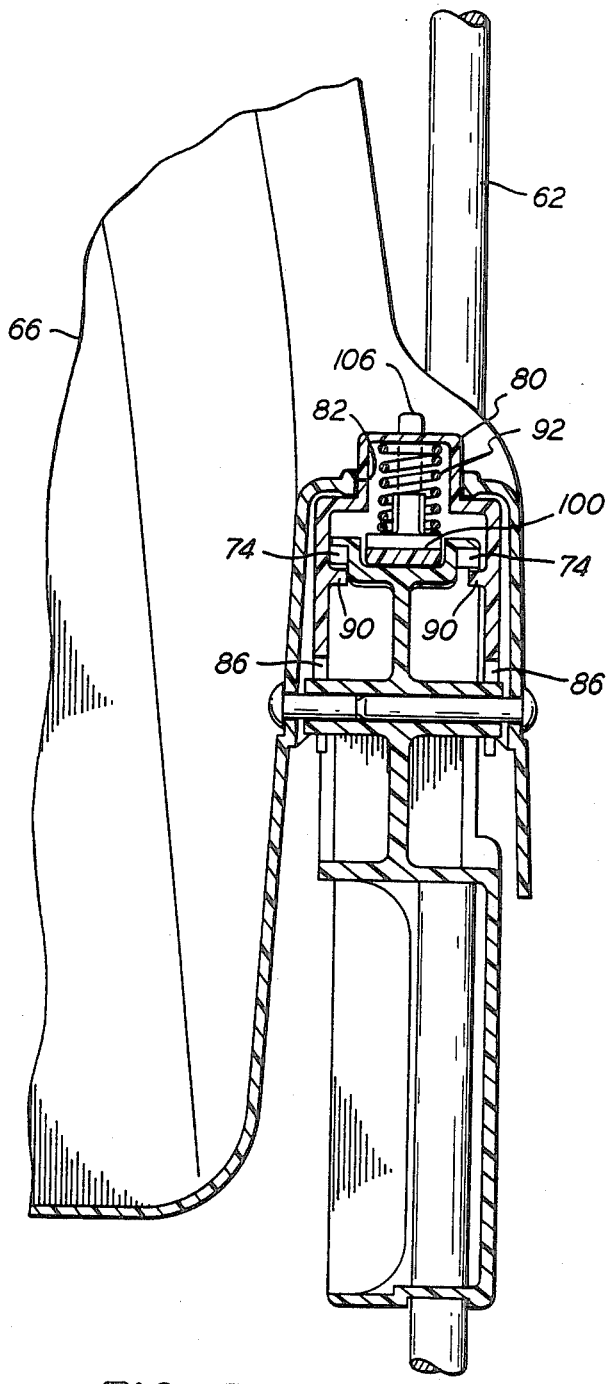
FIG. 5 is an enlarged section view taken substantially along line 5—5 of FIG. 3.

With reference to FIGS. 3-5, the chair means 60 compriss a plastic molded chair 66, and a pair of L-shaped chair mounts 68 for supporting chair 66 in a plurality of reclining positions varying from an upright sitting position A to a sleeping position B. One leg of each chair mount has an elongated opening for receiving, in secured relation, a leg 62 of the tubular frame. The other leg of each chair mount 68 has a projection 70 at the end thereof having a sectorial peripheral surface for supporting complementary surfaces of chair 66.

Latch means 72 are provided between chair 66 and each chair mount 68 for latching the chair in a selected one of the plurality of positions. The latch means 72 comprises a plurality of arcuately arranged first gear teeth 74 on each side of each projection 70, and angularly spaced therefrom, a plurality of arcuately arranged second gear teeth 76 on each side of each projection 70. The first gear teeth 74 are used when chair means 60 is used as a swing, and the second gear teeth 76 are used when the chair means is detached from the swing and used on a flat, rigid support surface.

The latch means 72 further comprises a reciprocally movable plunger 78 having a hollow push button 80 at one end extending through an opening 82 in chair 66. The opposite end of plunger 78 is bifurcated forming two legs 84 between which projection 70 is received. The legs 84 have slots 86 at the free end thereof for receiving laterally extending spindles 88 on projection 70, and lugs 90 on the inner surface thereof, each defining a notch for receiving a tooth. A spring 92 (FIG. 5) is interposed between the peripheral surface of projection 70 and the hollow push button 80 for biasing lugs 90 into engagement with one of the first or second gear teeth 74, 76 for releasably latching chair 66 to chair mounts 68 in a selected position. To change the reclining position of chair 66 in either of the first and second gear teeth positions, push button 80 is depressed retracting lug 90 from tooth 74, and the chair moved to a different position in which lug 90 engages a different tooth 74 for releasably holding the chair in a different reclining position.

Figure 6:
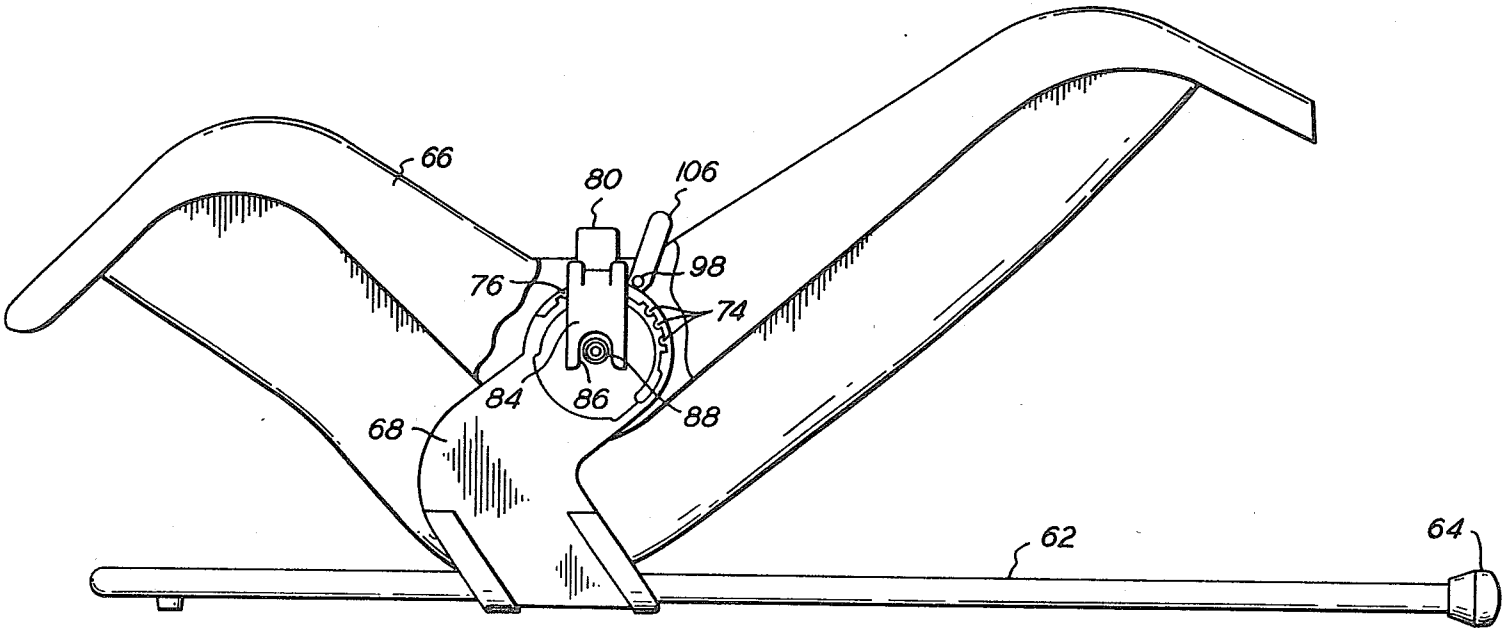
FIG. 6 is a side elevational view similar to FIG. 3 showing the chair and chair mount decoupled from the swing and moved relative to one another to form a rigidly supported baby chair in which the chair is adjustably movable between a plurality of reclining positions.

With reference to FIGS. 4–6, limiting means are provided for limiting operation of the latch means 72 to a selected one of the first and second gear teeth 74, 76 respectively, depending on whether the chair means 60 is used for swinging (FIG. 3) or used on a rigid support surface (FIG. 6) respectively. The limiting means comprises first and second grooves 94 (FIG. 4) in the peripheral surface of the projection for use with the first and second gear teeth 74, 76 respectively. The limiting means further comprises a stop member 96 pivotally movable on the chair by virtue of laterally extending spindles 98 interposed between projection 70 and a notch in chair 66. The stop member 96 has an arcuate end portion 100 having a depending lug 102 slidable within a selected one of the grooves 94 and engageable with shoulders 104 at the ends of the grooves for limiting movement of chair 66 relative to projection 70 to the distance between shoulders 104. The arcuate end portion 100 is interposed between the peripheral surface of projection 70 and spring 92 which biases end 100 into engagement with the projection. The stop member 96 further has a finger 106 at the opposite end extending through an opening in chair 66. Manual movement of finger 106 against the bias of spring 92 withdraws lug 102 from a groove 94 clear of shoulders 104 thereof. Upon simultaneous depression of push button 80, the chair 66 is free for movement from one to the other of the first and second gear teeth 74, 76 respectively.

Figure 7:
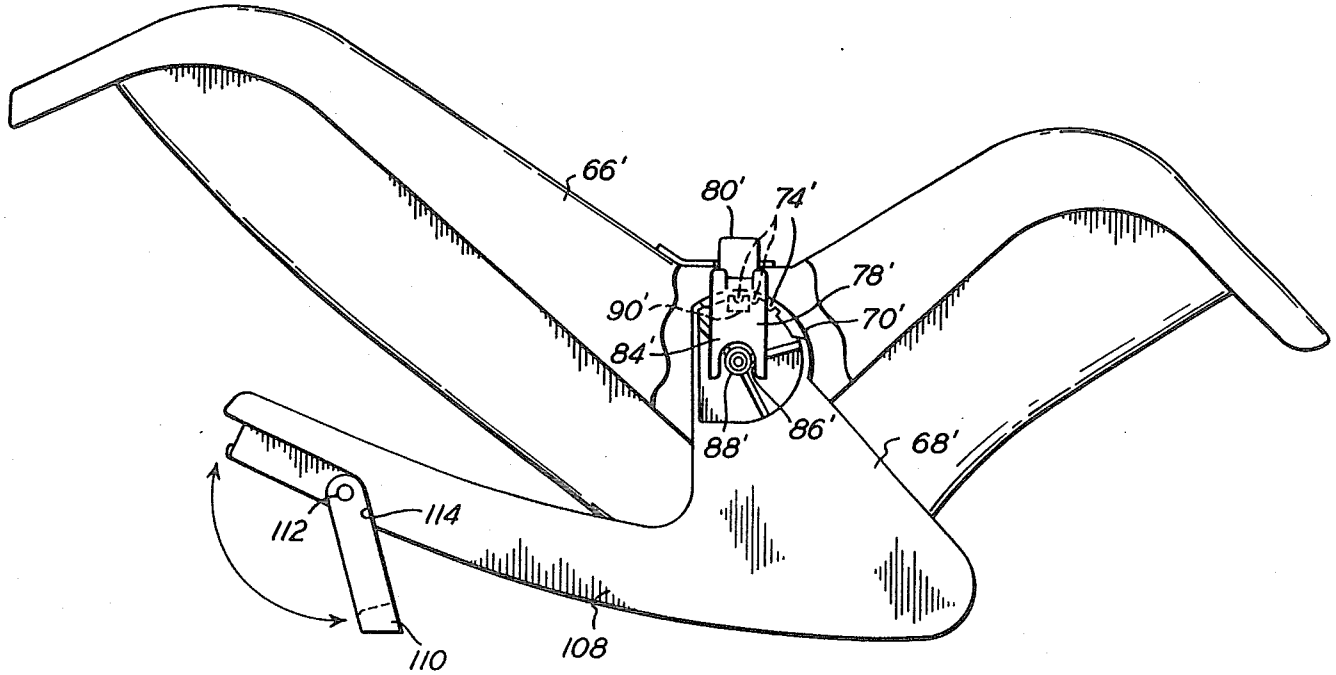
FIG. 7 is a side elevational view of another embodiment of a baby chair means having a rocking chair mount and a lever movable to a position for converting the rocking baby chair to a nonrocking chair.

Referring now to FIG. 7, another embodiment of the invention is shown in which parts similar to parts shown in FIGS. 1–6 are designated by the same numerals primed. The chair mounts 68' comprise a pair of rockers 108 to form a rocking chair means. In this embodiment, only one set of arcuately arranged gear teeth 74' are needed in cooperation with plunger 78' for varying the reclining position of chair 66' relative to the rocking chair mounts 68'. Accordingly, the limiting means are unnecessary and are omitted.

The rocking chair means further has a U-shaped lever 110 in which the free ends thereof are pivotally mounted on the rear of the rockers on pivots 112. The U-shaped lever 110 is movable to a retracted position in which it is held by a detent when the chair means is used as a rocking chair means. When the chair means is to be used on a rigid support surface in a nonrocking mode of operation, the lever 110 is moved to its extended position into engagement with shoulders 114 on the rockers 108.

The invention has been described in detail with particular reference to preferred embodiments thereof, but it will be understood that variations and modifications can be effected within the spirit and scope of the invention.

What is claimed is:

1. A dual purpose baby seat for use in combination with a frame and motor means for forming a motor driven swing, or as a seat for supporting a baby in a reclining position comprising a chair means having seat and back portions; pivot means on the chair means;

elongated leg means attached to said pivot means; positioning means for fixing said leg means in a plurality of swinging positions wherein said leg means extends generally above said chair whereby said chair means can be swingingly suspended from said frame by said leg means to function as a swing, and in a second seating position wherein said leg means extends generally rearwardly behind at least the back portion of said chair means whereby said chair means is at least partially supported in a reclining position by said leg means to function to support a baby; and first latch means for holding said leg means in a selected one of said plurality of swinging positions or in said seating position, and second latch means for allowing said leg means to be moved from said swinging positions to said seating position and preventing movement from said swinging positions to said seating position except when said second latch means are released.

2. A seat according to claim 1 wherein said positioning means comprises means for supporting said chair for movement among a plurality of reclining positions and a plurality of swinging positions.

3. A seat according to claim 2 wherein said leg has a fixed projection having a sectorial peripheral surface, and said chair means has a fixed bearing member mounted on said projection, said bearing member having a bearing surface complementary to said peripheral surface for allowing limited rotational movement of said chair relative to said leg, said chair further having a first opening extending therethrough.

4. A swing according to claim 3 wherein said first latch means comprises adjusting means between said chair means and said leg means for holding said chair in a selected one of a plurality of reclining positions relative to said leg means.

5. A swing according to claim 4 wherein said adjusting means comprises a plurality of arcuately arranged first gear teeth on said projection for use when said chair means is coupled to said support means, and a reciprocally movable plunger having a tooth selectively engageable with one of said first gear teeth, a push button at one end extending through said first opening in said chair means, and a spring on said plunger for biasing said tooth into meshing engagement with said first gear teeth.

6. A swing according to claim 5 wherein the opposite end of said plunger is bifurcated for receiving said projection therebetween, said projection has laterally extending spindles, said bifurcated end is slotted for receiving said spindles, and said spring is interposed between said bifurcated end and said projection.

7. A swing according to claim 6 wherein said adjusting means further comprises a plurality of arcuately arranged second gear teeth angularly spaced from said first gear teeth for use when said chair means is uncoupled from said support means, and said second latch means comprises means for selectively limiting operation of said plunger to only one of the said first and second gear teeth.

8. A swing according to claim 7 wherein said second latch means comprises first and second grooves in said peripheral surface for use with said first and second gear teeth respectively, said grooves having shoulders at each end thereof, and an arcuate stop member movable with said chair means and interposed between said peripheral and bearing surfaces, said stop member having a lug at one end slidable within a selected one of said grooves and engageable with said shoulders for positively limiting pivotal movement of said chair means relative to said leg means in either direction of rotation of said chair.

9. A swing according to claim 8 wherein said chair means has a second opening extending therethrough, said stop member is pivotally mounted on said chair and has a finger at the opposite end thereof extending in the opposite direction from said lug and through said second opening, said one end of said stop member further being interposed between said spring and said peripheral surface for biasing said lug in a groove, said finger adapted when manually pivotally depressed to withdraw said lug from one of said first and second grooves clear of said shoulders whereby when said finger and said push button are simultaneously depressed, said chair can be rotated on said projection to position said lug in the other of said first and second grooves and said tooth in engagement with the other of said first and second gear teeth.

* * * * *